US007934824B2

(12) United States Patent
Nishida

(10) Patent No.: US 7,934,824 B2
(45) Date of Patent: May 3, 2011

(54) IMAGE FORMING APPARATUS AND IMAGE FORMING METHOD

(75) Inventor: Isao Nishida, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 887 days.

(21) Appl. No.: 11/878,111

(22) Filed: Jul. 20, 2007

(65) Prior Publication Data

US 2008/0018690 A1 Jan. 24, 2008

(30) Foreign Application Priority Data

Jul. 21, 2006 (JP) ..... 2006-199542

(51) Int. Cl.
*B41J 29/377* (2006.01)

(52) U.S. Cl. ..... 347/102; 347/17; 347/194

(58) Field of Classification Search ..... 347/17, 347/18, 101, 102, 187, 194, 223
See application file for complete search history.

(56) References Cited

U.S. PATENT DOCUMENTS 5,043,741 A * 8/1991 Spehrley, Jr. ..... 347/88
5,502,475 A * 3/1996 Kaburagi et al. ..... 347/102
6,390,617 B1 * 5/2002 Iwao ..... 347/102
6,511,147 B2 * 1/2003 Kubota et al. ..... 347/16
2007/0019025 A1 * 1/2007 Jung ..... 347/17

FOREIGN PATENT DOCUMENTS

JP 9-314818 A 12/1997

* cited by examiner

*Primary Examiner* — Daniel Petkovsek
(74) *Attorney, Agent, or Firm* — Birch, Stewart, Kolasch & Birch, LLP

(57) ABSTRACT

An image forming apparatus has: an ejection head which ejects droplets of liquid toward a recording medium in accordance with image data; a hold device which holds the recording medium; a conveyance device which conveys the recording medium relatively to the ejection head while the recording medium is held by the hold device; a heating device which is provided with the hold device and is capable of heating a part of the recording medium selectively; and a control device which controls the heating device in accordance with the image data so that, before the droplets of the liquid are ejected by the ejection head, the recording medium is heated by the heating device in accordance with a heating pattern in which a first temperature not greater than an allowable temperature of the recording medium is set for a first region of the recording medium where a liquid ejection rate is not less than a first threshold value while a second temperature less than the first temperature is set for a second region of the recording medium where the liquid ejection rate is not greater than a second threshold value not greater than the first threshold value.

7 Claims, 10 Drawing Sheets

IMAGE FORMING APPARATUS AND IMAGE FORMING METHOD

BACKGROUND OF THE INVENTION

1. Field of the Invention

The present invention relates to an image forming apparatus and an image forming method for forming an image by ejecting ink toward a recording medium in the form of droplets, and more particularly, to an image forming apparatus and an image forming method for forming an image on a large area recording medium, such as a flexible sheet made of polyvinyl chloride (PVC), using an ink containing a solvent and a pigment as a coloring material.

2. Description of the Related Art

Inkjet recording apparatuses provided with an inkjet head in which a plurality of nozzles are arranged, have been known in the related art as image forming apparatuses. An inkjet recording apparatus of this kind forms dots on a recording medium so as to form an image, by ejecting ink in the form of droplets from nozzles toward the recording medium, while causing the inkjet head and the recording medium to move relatively to each other.

In the inkjet recording apparatus, one image is formed by combining dots that are formed of ink droplets ejected from the nozzles and deposited on the recording medium. In recent years, with the spread of digital cameras, and the like, the printing of digital images by means of an inkjet recording apparatus has become a common practice, and the demand in the image formation of high-definition and high-quality, such as photographic prints, has been increased.

In order for the inkjet recording apparatus to form images of high quality, removal of the ink solvent is an important issue, and it is desirable that the ink solvent be removed swiftly, immediately after the ink droplets are deposited on the recording medium.

One ink solvent removal method has been known in the related art in which the solvent is evaporated (dried) by heating the recording medium uniformly after depositing the ink droplets. Moreover, there have also been methods in which the heating energy efficiency is improved by selectively heating only those portions (the printed areas) where ink has been deposited on the recording medium.

For example, Japanese Patent Application Publication No. 9-314818 discloses a method in which the ink deposition areas on print paper are identified on the basis of print information, and those ink deposition areas on the print paper are selectively heated while the heating device constituted of a plurality of heating bodies that are arranged in a lattice configuration is caused to move according to the conveyance speed of the print paper.

However, in the method described in Japanese Patent Application Publication No. 9-314818, it is very difficult in practice to raise the temperature rapidly by heating only the printed areas on a moving print paper, because of delay in the response of the heating bodies. Moreover, since the thermal capacity of the print paper is generally small, then it may be difficult to achieve sufficient drying of the ink by heating the print paper before printing alone. Even if heating is carried out both before printing and during printing, there is still concern in that depending on the material of the print paper, the print paper is deformed due to thermal expansion caused by the partial heating of the print paper, resulting in degradation of the image.

SUMMARY OF THE INVENTION

The present invention has been contrived in view of these circumstances, an object thereof being to provide an image forming apparatus and an image forming method which promote the removal of ink solvent by heating of a recording medium and improve the quality of the image by preventing partial thermal deformation of the recording medium.

In order to attain the aforementioned object, the present invention is directed to an image forming apparatus comprising: an ejection head which ejects droplets of liquid toward a recording medium in accordance with image data; a hold device which holds the recording medium; a conveyance device which conveys the recording medium relatively to the ejection head while the recording medium is held by the hold device; a heating device which is provided with the hold device and is capable of heating a part of the recording medium selectively; and a control device which controls the heating device in accordance with the image data so that, before the droplets of the liquid are ejected by the ejection head, the recording medium is heated by the heating device in accordance with a heating pattern in which a first temperature not greater than an allowable temperature of the recording medium is set for a first region of the recording medium where a liquid ejection rate is not less than a first threshold value while a second temperature less than the first temperature is set for a second region of the recording medium where the liquid ejection rate is not greater than a second threshold value not greater than the first threshold value.

In this aspect of the invention, since the first region (high print density region) of the recording medium where the liquid ejection rate is equal to or greater than a prescribed value (the first threshold value) is heated and the second region (low print density region) where the liquid ejection rate is equal to or less than a prescribed value (the second threshold value) is also heated to a prescribed target temperature (the second temperature), then the temperature distribution of the recording medium becomes substantially uniform, and thermal deformation of the recording medium can be prevented while the drying of the liquid is promoted.

Preferably, the image forming apparatus further comprises a cooling device which cools the heating device so as to clear the heating pattern for the previous recording medium, after image formation on the previous recording medium held by the hold device is completed and before a new recording medium is held by the hold device.

In this aspect of the invention, since the previous heating pattern does not remain, it is possible to heat the new recording medium efficiently, from the start, according to a new heating pattern prepared for the new recording medium.

Preferably, the conveyance device is a belt conveyor; the hold device is a flat-shaped platen which is provided on the belt conveyor and holds an end portion of the recording medium; and the heating device includes a plurality of flat and square ceramic heaters which are arranged on the flat-shaped platen in a matrix configuration at a prescribed interval apart.

In this aspect of the invention, the surrounding areas can be prevented from being affected by the ceramic heater that is performing heating, and it is also possible to achieve compatibility with the rotating belt conveyor and achieve a simple composition of the apparatus.

Preferably, the ejection head is an ink ejection head which ejects inks of four colors; and the recording medium is heated by the heating device before ink ejection until after the ink ejection in accordance with the heating pattern in which the first temperature is set for the first region of the recording medium where a sum of ejection rates for the inks of the four colors is not less than 200% and the second temperature less than the first temperature is set for the second region of the recording medium where the sum of the ejection rates for the inks of the four colors is not greater than 50%.

In this aspect of the invention, the ink solvent can be dried efficiently by varying the target temperature to which the recording medium is heated, in accordance with the ink ejection rate, and it is also possible to prevent deformation of the recording medium.

Preferably, each of the inks contains a pigment as a coloring material and cyclohexanone as a solvent; and the recording medium is a flexible sheet made of polyvinyl chloride.

In this aspect of the invention, it is possible to form an image of high quality on a large print medium, such as signboard to be displayed in an outdoor street location, for instance.

In order to attain the aforementioned object, the present invention is also directed to an image forming method of forming an image by ejecting droplets of liquid toward a recording medium in accordance with image data, the method comprising the steps of: calculating a liquid ejection rate at which the droplets of the liquid are ejected toward the recording medium, in accordance with the image data; carrying out a first temperature control so that a first temperature not greater than an allowable temperature of the recording medium is set for a first region of the recording medium where the liquid ejection rate is not less than a first threshold value while a second temperature less than the first temperature is set for a second region of the recording medium where the liquid ejection rate is not greater than a second threshold value not greater than the first threshold value, before the droplets of the liquid are ejected toward the recording medium; and carrying out a second temperature control so that temperature of the recording medium is adjusted to the second temperature regardless of the liquid ejection rate, after the droplets of the liquid are ejected toward the recording medium.

In this aspect of the invention, the temperature distribution of the recording medium is made substantially uniform, and thermal deformation of the recording medium can be prevented while drying of the liquid is promoted.

In order to attain the aforementioned object, the present invention is also directed to a liquid droplet ejection apparatus, comprising: an ejection head which ejects droplets of liquid toward a recording medium in accordance with liquid ejection data; a hold device which holds the recording medium; a conveyance device which conveys the recording medium relatively to the ejection head while the recording medium is held by the hold device; a heating device which is provided with the hold device and selectively heats a part of the recording medium; a control device which controls the heating device in accordance with the liquid ejection data so that, before the droplets of the liquid are ejected by the ejection head, the recording medium is heated by the heating device in accordance with a heating pattern in which a first temperature not greater than an allowable temperature of the recording medium is set for a first region of the recording medium where a liquid ejection rate is not less than a first threshold value while a second temperature less than the first temperature is set for a second region of the recording medium where the liquid ejection rate is not greater than a second threshold value not greater than the first threshold value.

In this aspect of the invention, the first region (high print density region) of the recording medium where the liquid ejection rate is equal to or greater than a prescribed value (the first threshold value) is heated and the second region (low print density region) where the liquid ejection rate is equal to or less than a prescribed value (the second threshold value) are also heated to a prescribed set temperature (the second temperature); therefore, the temperature distribution of the recording medium becomes substantially uniform, and thermal deformation of the recording medium can be prevented while promoting the drying of the liquid.

In order to attain the aforementioned object, the present invention is also directed to a liquid droplet ejection method of ejecting droplets of liquid toward a recording medium in accordance with liquid ejection data, the method comprising the steps of: calculating a liquid ejection rate at which the droplets of the liquid are ejected toward the recording medium, in accordance with the liquid ejection data; carrying out a first temperature control so that a first temperature not greater than an allowable temperature of the recording medium is set for a first region of the recording medium where the liquid ejection rate is not less than a first threshold value while a second temperature less than the first temperature is set for a second region of the recording medium where the liquid ejection rate is not greater than a second threshold value, before the droplets of the liquid are ejected toward the recording medium; and carrying out a second temperature control so that temperature of the recording medium is adjusted to the second temperature regardless of the liquid ejection rate, after the droplets of the liquid are ejected toward the recording medium.

In this aspect of the invention, the temperature distribution of the recording medium becomes substantially uniform, and thermal deformation of the recording medium can be prevented while promoting drying of the liquid.

As described above, according to the present invention, the region (the second region) where the liquid ejection rate is equal to or less than a prescribed value (the second threshold value) is heated to a prescribed set temperature (the second temperature), as well as heating the region (the first region) on the recording medium where the liquid ejection rate is equal to or greater than a prescribed value (the first threshold value). Therefore, the temperature distribution of the recording medium becomes substantially uniform, and thermal deformation of the recording medium can be prevented while promoting the drying of the liquid.

BRIEF DESCRIPTION OF THE DRAWINGS

The nature of this invention, as well as other objects and benefits thereof, will be explained in the following with reference to the accompanying drawings, in which reference characters designate the same or similar parts throughout the figures and wherein.

DETAILED DESCRIPTION OF THE PREFERRED EMBODIMENTS

Figure 1:
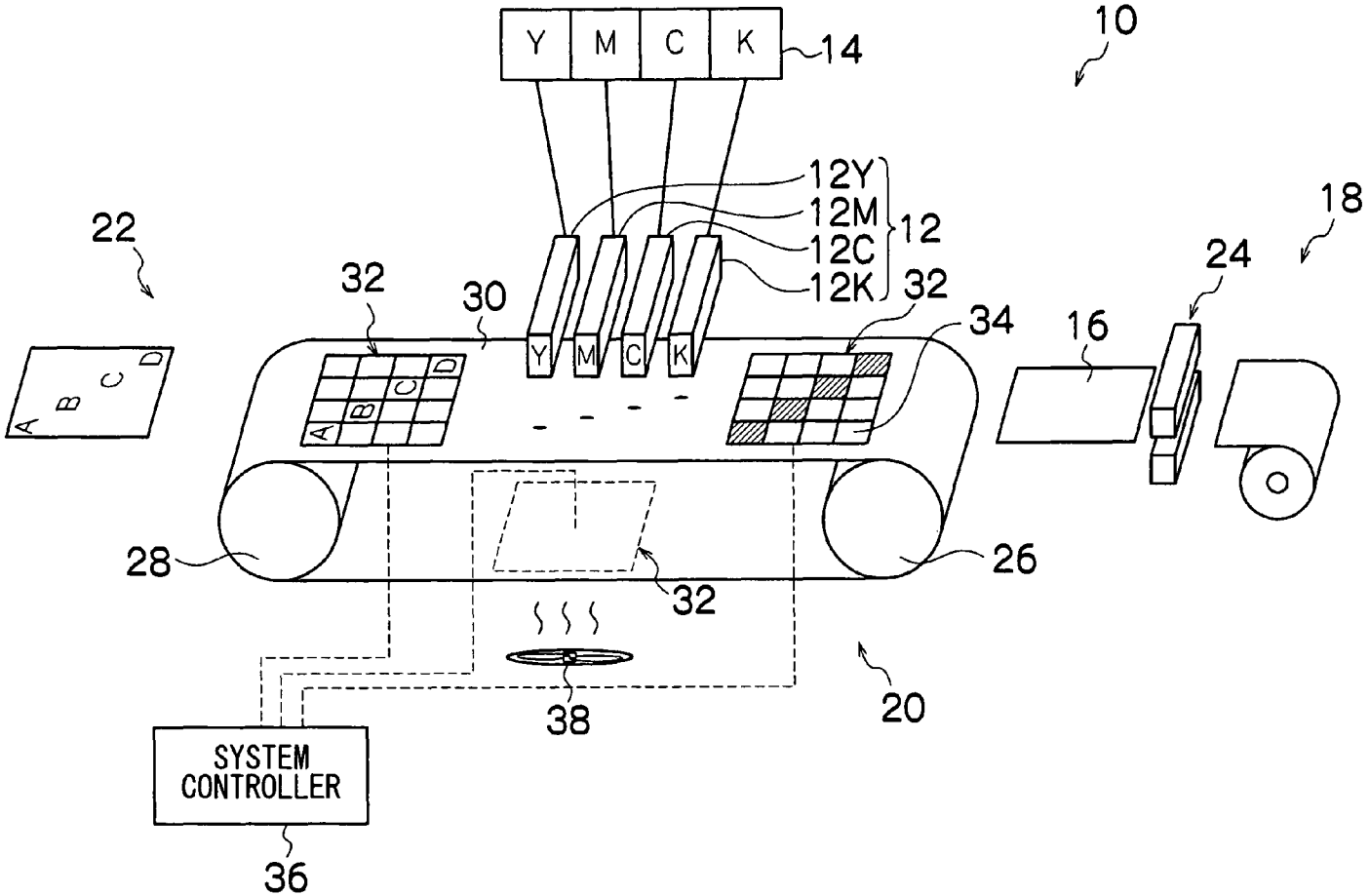
FIG. 1 is a general schematic drawing showing an inkjet recording apparatus which forms an image forming apparatus according to an embodiment of the present invention.

FIG. 1 is a general schematic drawing showing an inkjet recording apparatus which forms an image forming apparatus according to an embodiment of the present invention.

As shown in FIG. 1, the inkjet recording apparatus 10 according to the present embodiment includes: a print unit 12 including a Y ink print head 12Y, an M ink print head 12M, a C ink print head 12C and a K ink print head 12K, provided for respective colors of ink; an ink storing and loading unit 14 which stores ink to be supplied to the print heads 12Y, 12M, 12C and 12K; a recording medium supply unit 18 which supplies a recording medium 16; a conveyance unit 20 which conveys the recording medium 16 to the print unit 12; and a recording medium output unit 22 which outputs the printed recording medium (printed matter), to the exterior.

The print heads 12Y, 12M, 12C and 12M of the respective ink colors eject inks of the respective colors in the form of droplets, toward the surface of the recording medium 16. As shown in FIG. 1, the print heads 12Y, 12M, 12C and 12K are disposed in the sequence K, C, M and Y, from the upstream side, following the direction of conveyance of the recording medium 16 in the conveyance unit 20 (the right to left direction in FIG. 1).

The respective print heads 12Y, 12M, 12C and 12K are full line heads that are disposed through a length that is substantially the same as the width of the conveyance path in a substantially perpendicular direction to the direction of conveyance of the recording medium. The structures of the print heads 12Y, 12M, 12C and 12K are described hereinafter.

The ink used in the present embodiment is a solvent-based ink, and such a solvent-based ink may contain a pigment as the coloring material and cyclohexanone as the solvent, for example.

The ink storing and loading unit 14 supplies inks of the respective colors to the print heads 12Y, 12M, 12C and 12K of the print unit 12, and the ink storing and loading unit 14 includes ink tanks storing inks (solvent-based inks) of the colors corresponding to the print heads 12Y, 12M, 12C and 12K, the respective tanks being connected to the print heads 12Y, 12M, 12C and 12K by means of ink supply channels.

The ink storing and loading unit 14 has a warning device (for example, a display device, an alarm sound generator, or the like) for warning when the remaining amount of any ink is low, and has a mechanism for preventing loading errors among the colors.

The recording medium supply unit 18 supplies a recording medium 16 to the print unit 12. Although a magazine for rolled recording medium (continuous recording medium) is adopted as one example of the recording medium supply unit 18 as shown in FIG. 1, it is also possible to use conjointly a plurality of magazines having different medium widths, medium materials, and the like. Moreover, the recording medium 16 may be supplied in cassettes which contain cut recording media loaded in layers and which are used jointly or in lieu of magazines for rolled recording media.

In the case of a configuration in which rolled recording medium is used, a cutter 24 is provided as shown in FIG. 1, and the rolled recording medium is cut to a desired size by the cutter 24. When cut recording medium is used, the cutter 24 is not required.

In the case of a configuration in which a plurality of types of recording medium can be used, it is preferable that an information recording medium, such as a bar code and a wireless tag, containing information about the type of recording medium be attached to the magazine, and by reading the information contained in the information recording medium with a predetermined reading device, the type of recording medium to be used is automatically determined, and ink-droplet ejection is controlled so that the ink-droplets are ejected in an appropriate manner in accordance with the type of recording medium.

In the present embodiment, a flexible sheet made of polyvinyl chloride, for example, is used as the recording medium 16.

The recording medium 16 delivered from the recording medium supply unit 18 may retain curl due to having been loaded in the magazine. In order to remove the curl, a decurling unit is provided and heat may be applied to the recording medium 16 by a heating drum, in the direction opposite to the direction of curl in the magazine, for example. In this case, the heating temperature is preferably controlled in such a manner that the medium has a curl in which the surface on which the print is to be made is slightly rounded in the outward direction.

The cut recording medium 16 is delivered to the conveyance unit 20. The conveyance unit 20 has a structure in which an endless belt conveyor 30 is provided between the rollers 26 and 28. A platen 32 is disposed on the surface of the belt conveyor 30, and the platen 32 is configured to hold the recording medium 16 in a flat state and be capable of heating the ink deposition areas selectively by means of heaters provided therewith.

One preferred embodiment of the heater provided on the platen 32 is a heater constituted by a plurality of flat and square ceramic heaters 34 as the heat generating bodies which are arranged in a matrix configuration. Preferably, the plurality of ceramic heaters 34 are arranged at a uniform pitch, and in other words, the distance between any two adjacent ceramic heaters is preferably uniform. It is thereby possible to prevent the ceramic heater that is not performing heating (in a switch-off state) from being affected by the ceramic heater that is performing heating (in a switch-on state) and adjacent to the switch-off ceramic heater. Moreover, it is also possible to make the ceramic heaters 34 arranged on the belt conveyor 30 compatible with the bending of the belt conveyor 30 when the conveyor 30 rotates about the roller sections 26 and 28.

A system controller 36 is provided so as to control the ceramic heaters 34 that are arranged in a matrix configuration on the platen 32. In accordance with image information, the system controller 36 identifies the region (high print density region) where ink droplets are deposited on the recording medium 16 at a liquid ejection rate (which is also referred to as the "ink ejection rate", "print rate", or "ejection rate") not less than a prescribed value, and the system controller 36 implements control in such a manner that the ceramic heaters 34 corresponding to the high print density region are switched on, thereby heating the high print density region of the recording medium 16 where ink is to be deposited at high density.

In such a case, if a specified region on the recording medium 16 is heated selectively, then the recording medium 16 produces thermal deformation due to thermal expansion caused by the temperature difference between the heated areas and the other areas. Therefore, in order to prevent thermal deformation of this kind, the areas (including a low print density region) other than the high print density region are also heated.

More specifically, the target temperatures are set respectively for the high print density region and the low print density region (and another target temperature may be set for another region, according to requirements). Heating control is thus carried out with respect to the recording medium 16 on the basis of a heating pattern in which target temperatures are set for the areas of the recording medium 16 respectively.

The heating control is described in more detail below.

The ceramic heaters 34 on the platen 32 heat the recording medium 16 in advance before printing, and they continue heating after printing (and during printing) as well, in order to promote the removal of solvent contained in the ink deposited on the recording medium 16. The printed recording medium 16 is output from the recording medium output unit 22. The platen 32 moves with the movement of the belt conveyor 30, and receives the supply of a next recording medium 16. In order to remove the effects of the heating pattern for the previous recording medium 16, the belt conveyor 30 is cooled by a cooling fan 38 when it is conveyed to the side opposite to the print unit 12. By cooling the platen 32 before receiving the supply of a new recording medium 16 in this way, it is possible to heat the platen 32 (and the recording medium 16 held on the platen 32), from the start, in accordance with a new heating pattern that corresponds to the new recording medium 16.

Next, the structure of the print heads 12Y, 12M, 12C and 12K is described below. The print heads 12Y, 12M, 12C and 12K provided for the respective ink colors have a common structure, and a reference numeral 50 is hereinafter designated to a representative example of these print heads 50.

Figure 2:
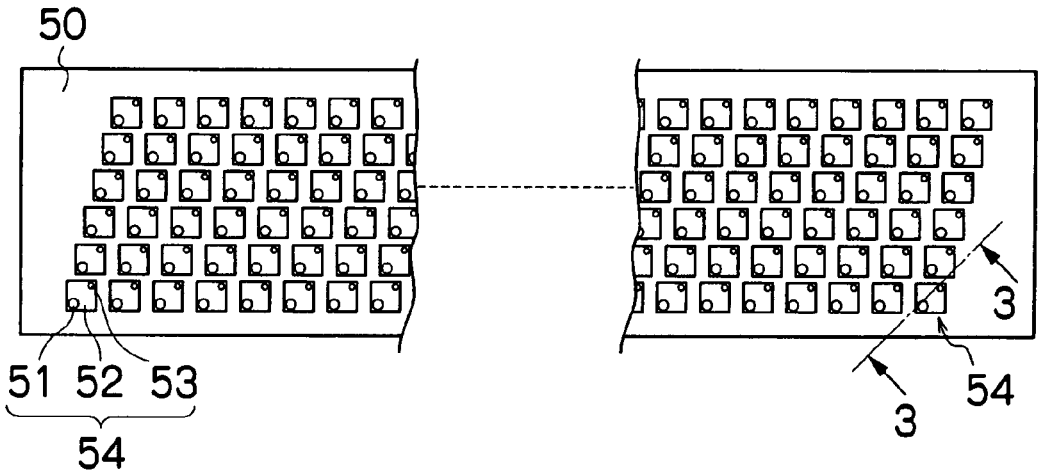
FIG. 2 is a plan view perspective diagram showing an example of the structure of a print head in the inkjet recording apparatus shown in FIG. 1.

FIG. 2 is a perspective plan diagram showing an example of the structure of a print head 50 (12Y, 12M, 12C and 12K).

As shown in FIG. 2, the print head 50 according to the present embodiment achieves a high density arrangement of nozzles 51 by arranging pressure chamber units 54 two-dimensionally. Each of the pressure chamber units 54 includes a nozzle for ejecting ink, a pressure chamber 52 for applying pressure to the ink in order to eject ink, and an ink supply port 53 for supplying ink to the pressure chamber 52 from a common flow channel (not illustrated).

As shown in FIG. 2, each pressure chamber 52 has an approximately square shape when viewed from above, and a nozzle 51 is formed at one end of a diagonal of the chamber while an ink supply port 53 is provided at the other end thereof.

Figure 3:
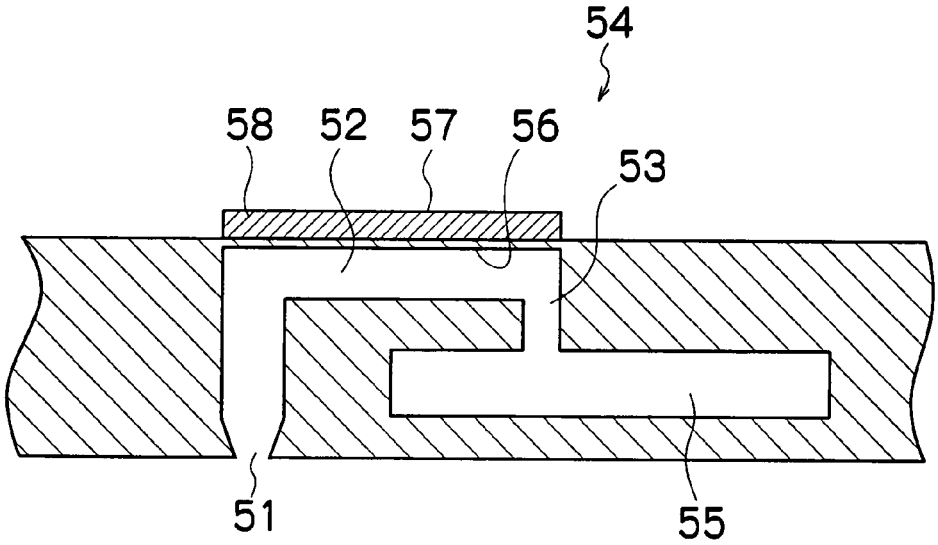
FIG. 3 is a cross-sectional diagram showing the structure of a pressure chamber unit of the print head in FIG. 2.

Furthermore, FIG. 3 shows a cross-sectional view of one pressure chamber unit 54 along the dashed-dotted line 3-3 in FIG. 2.

As shown in FIG. 3, each pressure chamber unit 54 is constituted by a pressure chamber 52 formed with a nozzle 51 that ejects ink. The pressure chamber 52 is connected with a common flow channel 55 for supplying ink via a supply port 53, and one surface (the ceiling in FIG. 3) of the pressure chamber 52 is constituted by a diaphragm 56 for normal ejection. A piezoelectric element 58 provided with an individual electrode 57 is bonded to the upper part of the diaphragm 56.

When a drive voltage is applied to this individual electrode 57, the piezoelectric element 58 deforms, the diaphragm 56 bends, and the volume of the pressure chamber 52 decreases, in such a manner that ink is ejected from the nozzle 51. When ink has been ejected, the piezoelectric element 58 returns to its original position, the volume of the pressure chamber 52 returns to its original size, and new ink is supplied into the pressure chamber 52 from the common supply channel 55 via the supply port 53.

Figure 4:
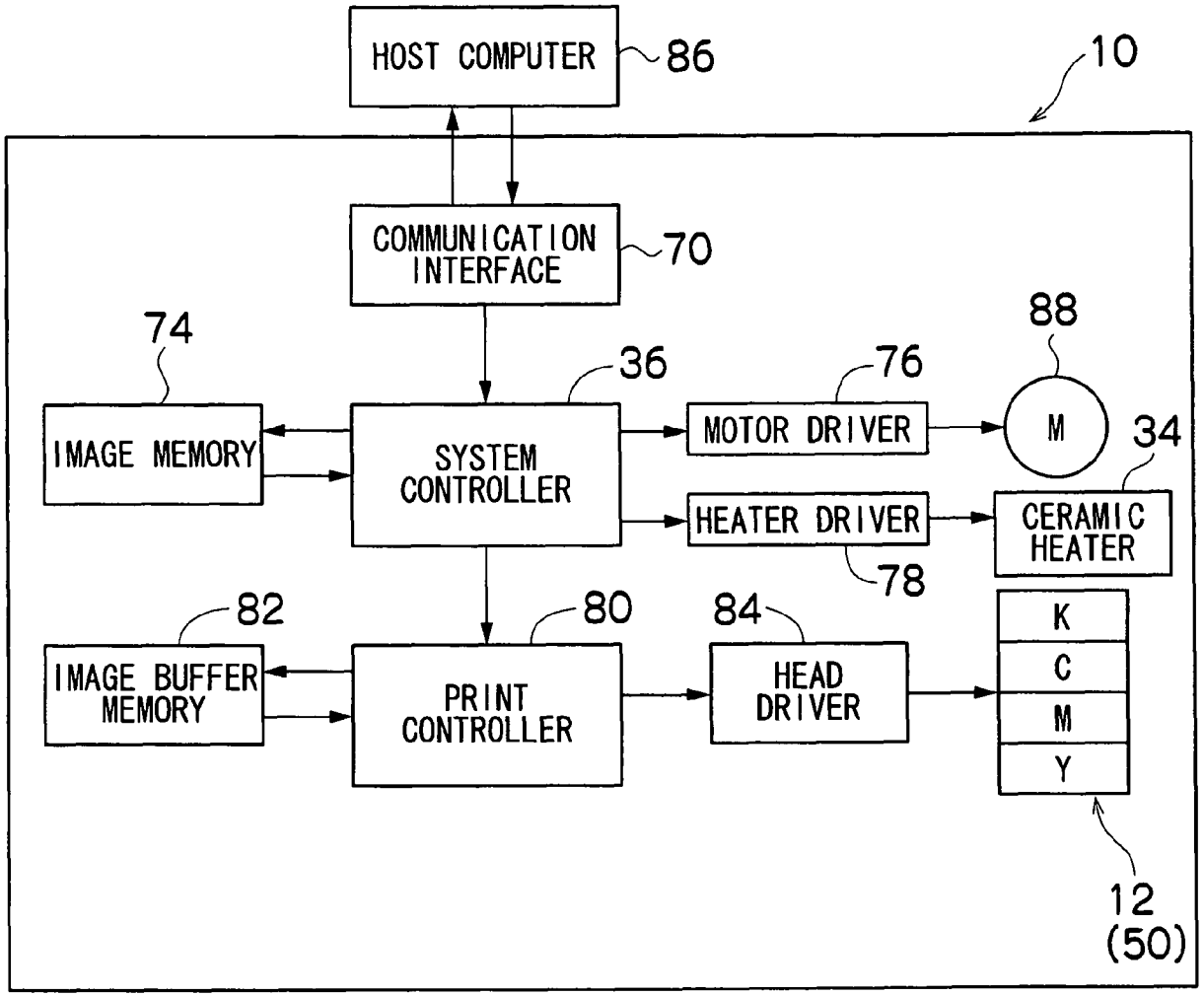
FIG. 4 is a principal block diagram showing the system composition of the inkjet recording apparatus according to an embodiment of the present invention.

FIG. 4 is a principal block diagram showing the system configuration of the inkjet recording apparatus 10. The inkjet recording apparatus 10 includes a communication interface 70, a system controller 36, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE 1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 36. The image memory 74 is not limited to a memory composed of semiconductor elements, and a hard disk drive or another magnetic medium may be used.

The system controller 36 is a control unit for controlling the various sections, such as the communication interface 70, the image memory 74, the motor driver 76, the heater driver 78, and the like. The system controller 36 is constituted by a central processing unit (CPU) and peripheral circuits thereof, and the like, and in addition to controlling communications with the host computer 86 and controlling reading and writing from and to the image memory 74, and the like, it also generates control signals for controlling the motor 88 of the conveyance system and the ceramic heater 34.

The motor driver 76 is a driver (drive circuit) which drives the motor 88 in accordance with instructions from the system controller 36. The heater driver 78 drives the ceramic heaters 34 arranged on the platen 32 in accordance with commands from the system controller 36.

The print controller 80 has a signal processing function for performing various tasks, compensations, and other types of processing for generating print control signals from the image data stored in the image memory 74 in accordance with commands from the system controller 36 so as to supply the print control signals (print data) generated from the image data to the head driver 84. Required signal processing is carried out in the print controller 80, and the ejection amount and the ejection timing of the ink droplets from the respective print heads 50 are controlled via the head driver 84, on the basis of the print data (liquid ejection data). By this means, desired dot size and dot positions can be achieved.

The print controller 80 is provided with the image buffer memory 82; and image data, parameters, and other data are temporarily stored in the image buffer memory 82 when image data is processed in the print controller 80. The embodiment shown in FIG. 4 is one in which the image buffer memory 82 accompanies the print controller 80; however, the image memory 74 may also serve as the image buffer memory 82. Also possible is an embodiment in which the print controller 80 and the system controller 36 are integrated to form a single processor.

The head driver 84 drives the pressure generating devices of the print heads 50 of the respective colors on the basis of print data supplied by the print controller 80. The head driver 84 can be provided with a feedback control system for maintaining constant drive conditions for the print heads.

Although not shown in FIG. 1, a print determination unit which determines the print results may be provided on the downstream side of the print unit 12 in terms of the conveyance direction, and the print controller 80 may carry out various types of correction with respect to the print head 50 in accordance with information obtained from the print determination unit.

There follows a detailed description of preferred embodiments relating to the platen 32 provided with heaters which can perform selective heating in the high print density region where ink is ejected toward the recording medium at an ejection rate (print rate) not less than a prescribed value. The following also describes a concrete heating control method for the platen 32, and in particular, a control method that promotes ink solvent removal while preventing thermal deformation of the recording medium due to selective heating.

In the present embodiment, the recording medium is a flexible sheet made of polyvinyl chloride (PVC), and more specifically, the recording medium is a large recording medium having a width of 1650 mm and a length of 3100 mm, for example, designed for outdoors display applications, such as signboards, railway posters, and the like. Moreover, a solvent-based ink that contains cyclohexanone as a solvent is used as the ink.

Figure 5:
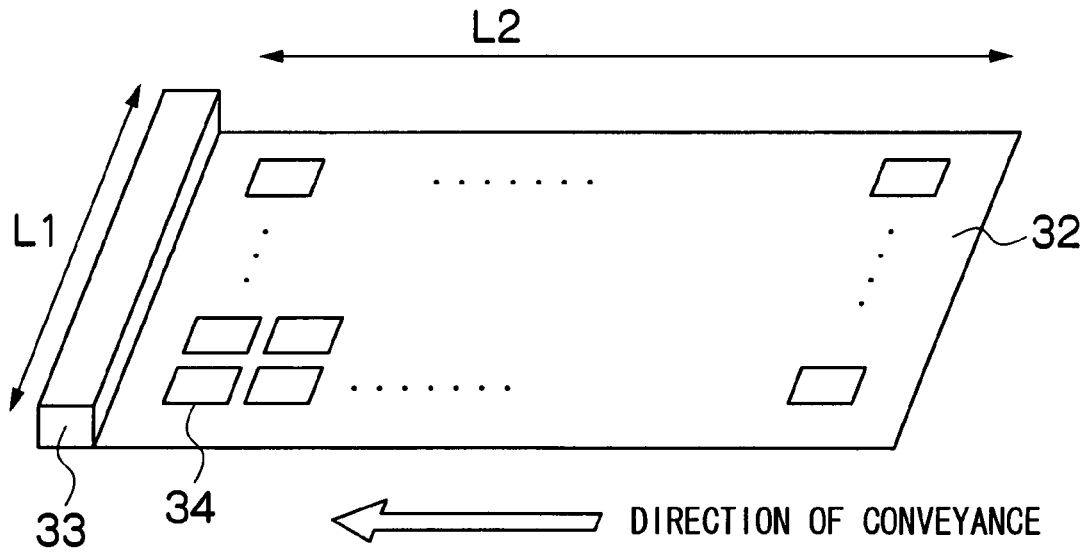
FIG. 5 is a perspective diagram showing an approximate view of a platen according to an embodiment of the present invention.

FIG. 5 is a perspective diagram showing an enlarged view of the platen 32 provided with heaters.

As described above, the platen 32 heats the recording medium 16 during the conveyance of the recording medium 16, and the platen 32 has a size which corresponds to the size of the recording medium 16. In the present embodiment, the recording medium 16 is a PVC sheet having a width of 1650 mm as described above, and the platen 32 has a large and flat shape which is slightly larger than the size of the recording medium 16.

As shown in FIG. 5, flat square ceramic heaters 34 each having a size of 100 mm×100 mm are arranged on the surface of the platen 32 in a matrix configuration (matrix of 16×30) in which sixteen heaters are arranged in the longitudinal direction and thirty heaters are arranged in the lateral direction at an interval of several millimeters. The plurality of ceramic heaters 34 are each arranged at a uniform spacing from the adjacent heaters in this way in order to provide thermal insulation between the heaters in such a manner that a ceramic heater 34 that is performing heating (in a switch-on state) does not affect the adjacent ceramic heaters 34 that are not performing heating (in a switch-off state), and in order that the ceramic heaters 34 arranged on the belt conveyor 30 are compatible with the bending of the belt conveyor 30 when the conveyor 30 is rotated about the roller sections 26 and 28.

In the case of this matrix configuration (matrix of 16×30), taking the width of the platen 32 to be L1 and taking the length of the platen 32 to be L2, then L1 is longer than 1600 mm (=16×100 mm) by an amount corresponding to the sum of the heater intervals and the widths on both end portions, and L2 is longer than 3000 mm (=30×100 mm) by an amount corresponding to the sum of the heater intervals and the widths on both front end portion and back end portion.

A positioning device 33 which detects and holds the end portion of the recording medium 16 is provided at the end portion of the platen 32 on the downstream side in terms of the conveyance direction. There are no particular restrictions on this positioning device 33, and a preferred embodiment of the positioning device 33 has a configuration in which the end of the recording medium 16 is held by means of a pressing hook, or the like, when the end of the recording medium 16 makes contact with the positioning device 33. A composition is preferably adopted in which the recording medium 16 is supplied onto the platen 32 at a speed that is faster than the speed of movement of the platen 32 when the platen 32 has passed around the roller 26 adjacent to the recording medium supply unit 18 due to the movement of the belt conveyor 30 as shown in FIG. 1. By means of this composition, the end portion of the recording medium 16 comes into contact with the contact section of the positing device 33, and the end portion of the recording medium 16 is held by the pressing hook provided in the positioning device 33 when the end portion of the recording medium 16 is in contact with the contact section of the positioning device 33 (the recording medium 16 may be held by the pressing hook according to the contact between the recording medium 16 and the contact section of the positioning device 33).

Figure 6:
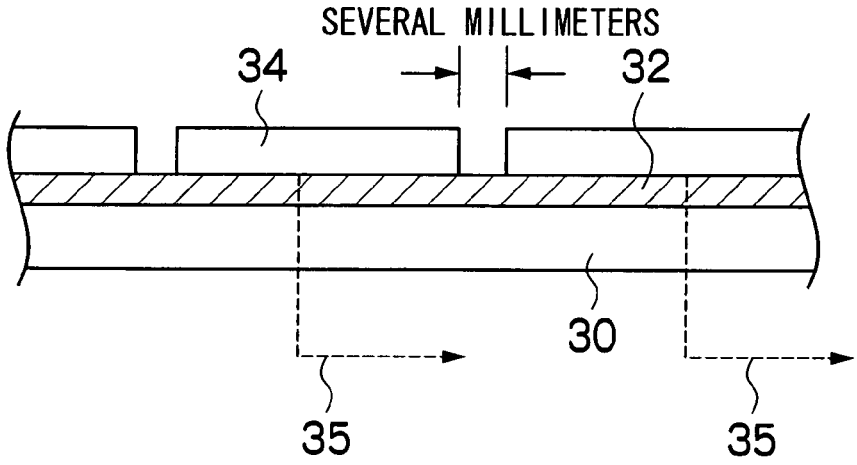
FIG. 6 is a cross-sectional diagram showing the platen disposed on a belt conveyor.

FIG. 6 is a partial cross-sectional diagram of the platen 32 disposed on a belt conveyor 30. As shown in FIG. 6, the platen 32 is disposed on the belt conveyor 30, and the flat ceramic heaters 34 are arranged on the platen 32 at a pitch of several millimeters. Wires 35 are connected respectively to these ceramic heaters 34, in such a manner that each of the ceramic heaters 34 can switch on and off independently. The ceramic heaters 34 are provided with temperature sensors. Although not shown in FIG. 6, the wires 35 are connected to the system controller 36 via rotatable contacts so that both the connection between the system controller 36 and the wires 35 and the movement of the belt conveyor 30 are achieved.

Next, the temperature control of the ceramic heaters 34 on the platen 32 which holds the recording medium 16 during conveyance is described below.

In the present embodiment, removal of solvent is promoted by selectively heating the high print density region where ink is ejected toward the recording medium 16 at an ejection rate not less than a prescribed value, on the basis of the image information, and moreover, in order to prevent thermal deformation of the recording medium 16 due to the selective heating, the low print density region where the ink is ejected at an ejection rate not greater than a prescribed value, is also heated uniformly.

In this case, the high print density region and the low print density region are more specifically defined as follows. The recording medium 16 is divided into a plurality of areas corresponding to the ceramic heaters 34, which each have a size of 100 mm×100 mm and are arranged on the platen 32 holding the recording medium 16. If the total of the ejection rates (print rates) of the inks of four colors is not less than 200% (in other words, the average ejection rate is 50% or greater for each of the inks of colors) in a specific area of the recording medium 16, then that area is included in the "high print density region" (in other words, the "high print density region" is a collection of the areas of this kind). If, on the other hand, the total of the ejection rates of the inks of four colors is not greater than 50% in a specific area of the recording medium 16, then that area is included in the "low print density region".

Figure 7:
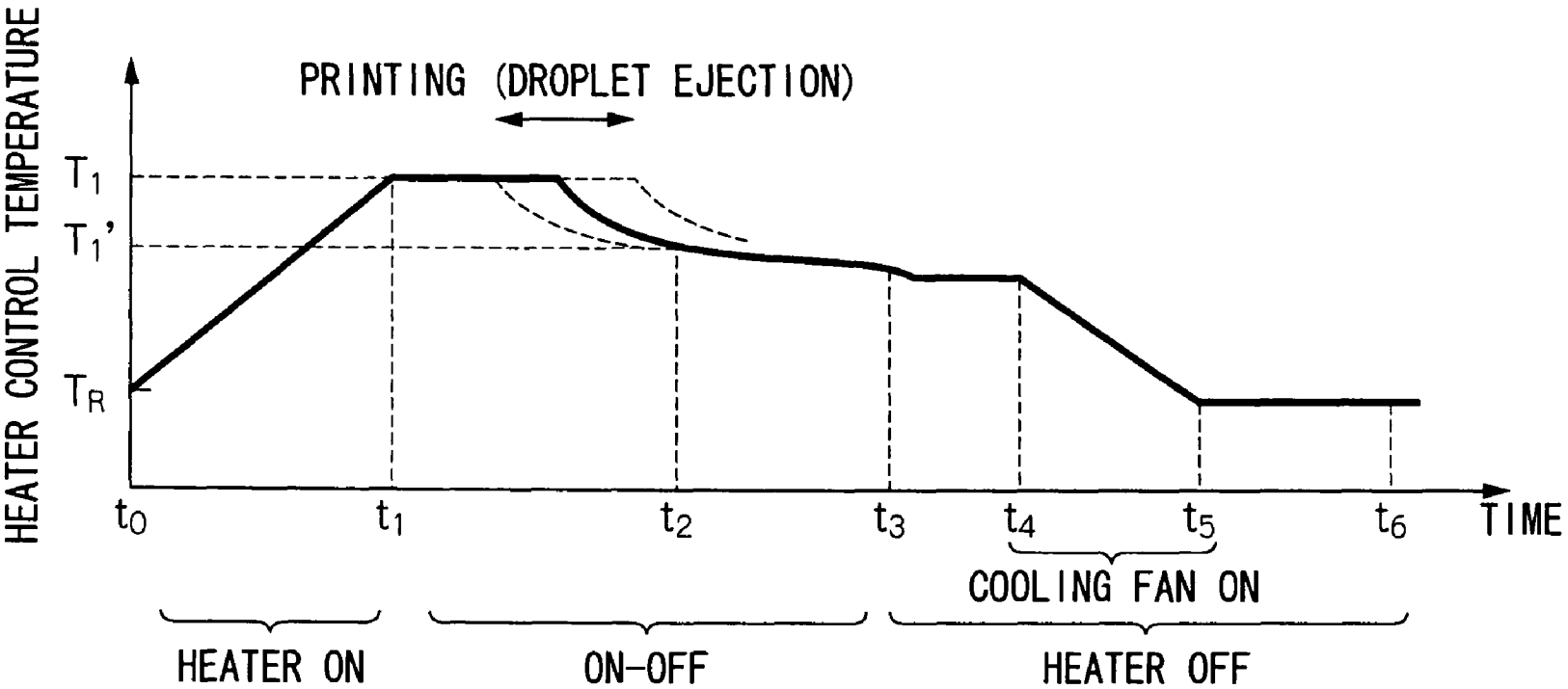
FIG. 7 is a diagram showing an example of temperature control for the high print density region.

FIG. 7 is a diagram showing an aspect of temperature control for a ceramic heater 34 corresponding to the high print density region.

In FIG. 7, the horizontal axis represents the time and the vertical axis represents the heater control temperature. Here, the time on the horizontal axis indicates the time of one cycle of the belt conveyor 30, from the time at which the recording medium 16 is placed on the platen 32 and the ceramic heaters 34 start heating, through printing onto the recording medium 16 and output of the recording medium 16, followed by cooling of the platen 32 on the side opposite to the print unit 12, until the belt conveyor 30 reaches the position where the next sheet of recording medium 16 is placed thereon.

Temperatures indicated on the vertical axis have the following meanings: $T_R$ is the room temperature; $T_1$ is the allowable heating temperature for the recording medium 16; and $T_1'$ is the temperature to which the recording medium 16 having a temperature of $T_1$ is cooled due to the deposited ink droplets. For example, if the room temperature $T_R$ is 20° C. and the allowable temperature $T_1$ for the recording medium 16 made of polyvinyl chloride is 70° C., the temperature $T_1'$ can be approximately 65° C.

As shown in FIG. 7, if a specific area of the recording medium 16 belongs to the high print density region, then that specific area is heated to the allowable temperature $T_1$ before printing. For example, in the case where the recording medium 16 is a PVC sheet having a width of 1650 mm and a length of 3100 mm and the recording medium conveyance speed is 1000 mm/minute, then the time period from $t_0$ to $t_1$ during which the preliminary heating is carried out before printing is 3 min. During this time period from $t_0$ to $t_1$, the ceramic heaters 34 corresponding to the areas (the high print density region) having a prescribed ejection rate or greater are switched on and perform heating until reaching the allowable temperature $T_1$.

During the next time period from $t_1$ to $t_2$, the ceramic heaters 34 are controlled and switched on and off so as to keep the temperature at the allowable temperature $T_1$. In the time period from $t_1$ to $t_2$, printing is carried out from the print unit 12 onto the recording medium 16. If printing is carried out at a print density of 600×600 dots per inch (dpi), for example, then when ink droplets deposit on a specified area of the recording medium 16, heat is absorbed by the ink droplets, and the temperature of that area of the recording medium 16 (the ceramic heaters 34) falls to $T_1'$ as shown in FIG. 7. In FIG. 7, other two cases of different droplet ejection timings are depicted by dotted lines.

During the next time period from $t_2$ to $t_3$, the ceramic heaters 34 are controlled and switched on and off. The solvent in the ink droplets deposited on the recording medium 16 is removed in this time period by evaporation and drying, and the recording medium 16 is then output from the recording medium output unit 22.

During the next time period from $t_3$ to $t_4$ and subsequently, the ceramic heaters 34 are switched off and the heating of the platen 32 is halted. When the platen 32 has turned about the roller 28 and is conveyed on the under side of the belt conveyor 30, then during the time period from $t_4$ to $t_5$, the platen 32 (ceramic heaters 34) are cooled to the room temperature $T_R$ by the cooling fan 38 and the previous heating pattern is thereby deleted. During the time period from $t_5$ to $t_6$, with the movement of the belt conveyor 30, the platen 32 turns about the roller 26 and is conveyed to a position where it receives the supply of the next recording medium 16.

Figure 8:
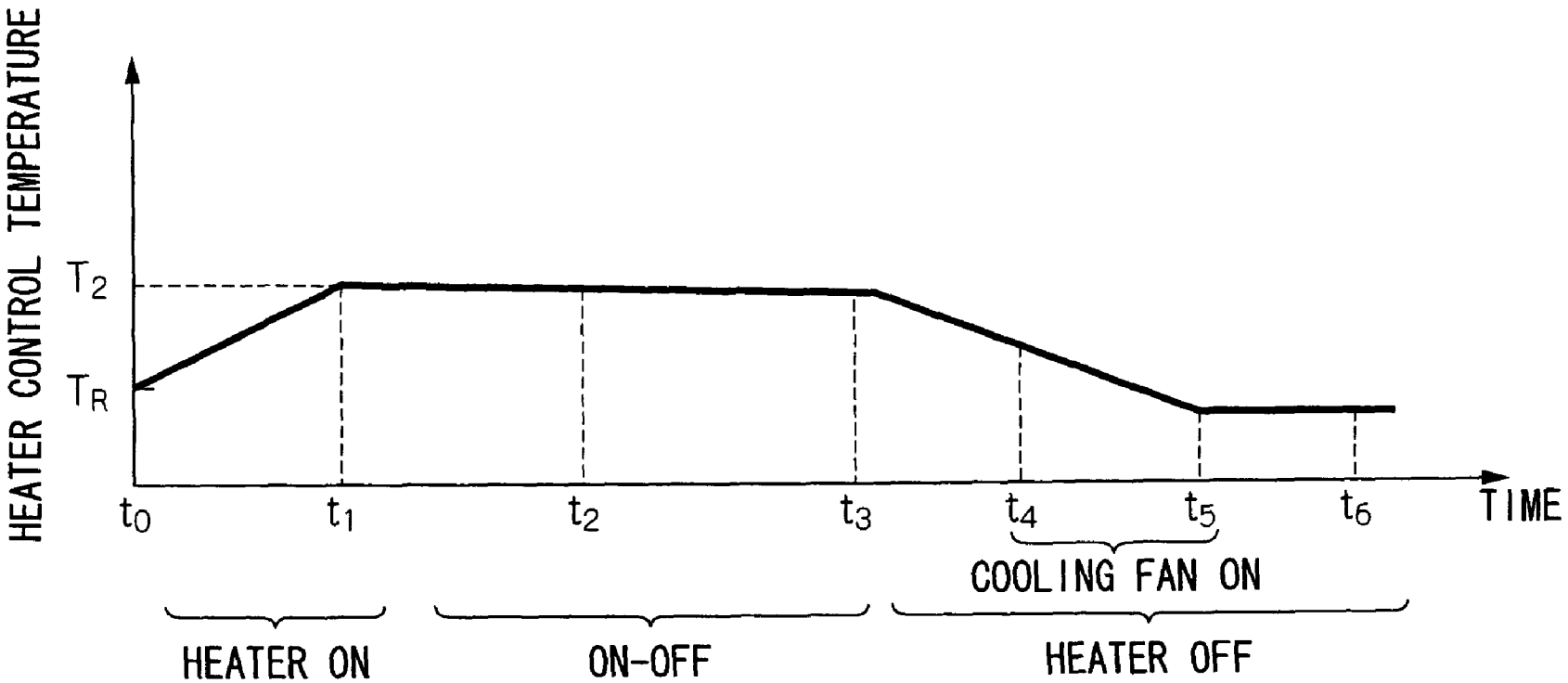
FIG. 8 is a diagram showing an example of temperature control for the low print density region.

FIG. 8 is a diagram showing an aspect of temperature control for a ceramic heater 34 corresponding to the low print density region (the ejection rate: 0%).

Similarly to FIG. 7, in FIG. 8 also, the horizontal axis represents the time and the vertical axis represents the heater control temperature. FIG. 8 shows temperature control in one cycle of the belt conveyor 30 which conveys the platen 32. Moreover, temperatures indicated on the vertical axis have the following meanings: $T_R$ is the room temperature; and $T_2$ is a prescribed temperature to which the low print density region (a region of the recording medium 16 having an ejection rate equal to or lower than a prescribed rate) is set to, in order to prevent expansion and contraction of the recording medium 16 (thermal deformation caused by selective heating).

As shown in FIG. 8, in the low print density region, during the time period from $t_0$ to $t_1$, the recording medium 16 is heated to the temperature $T_2$, which is of a level required to prevent expansion or contraction of the recording medium 16. This temperature $T_2$ is generally around 65° C., in the case where the recording medium 16 is a PVC sheet, for example.

During the next time periods from $t_1$ to $t_2$ and from $t_2$ to $t_3$, the ceramic heaters 34 for the low print density region are controlled and switched on and off so as to maintain the temperature $T_2$, thereby suppressing local thermal deformation of the recording medium 16. At the time point of $t_3$ and thereafter, the ceramic heaters 34 are switched off and the heating is halted.

In cases of the low print density region where the ejection rate is more than 0% and not greater than 50%, the temperature of the low print density region drops due to the deposition of the ink droplets; however, the low print density region is heated to the prescribed temperature by the corresponding ceramic heater 34.

Figure 9:
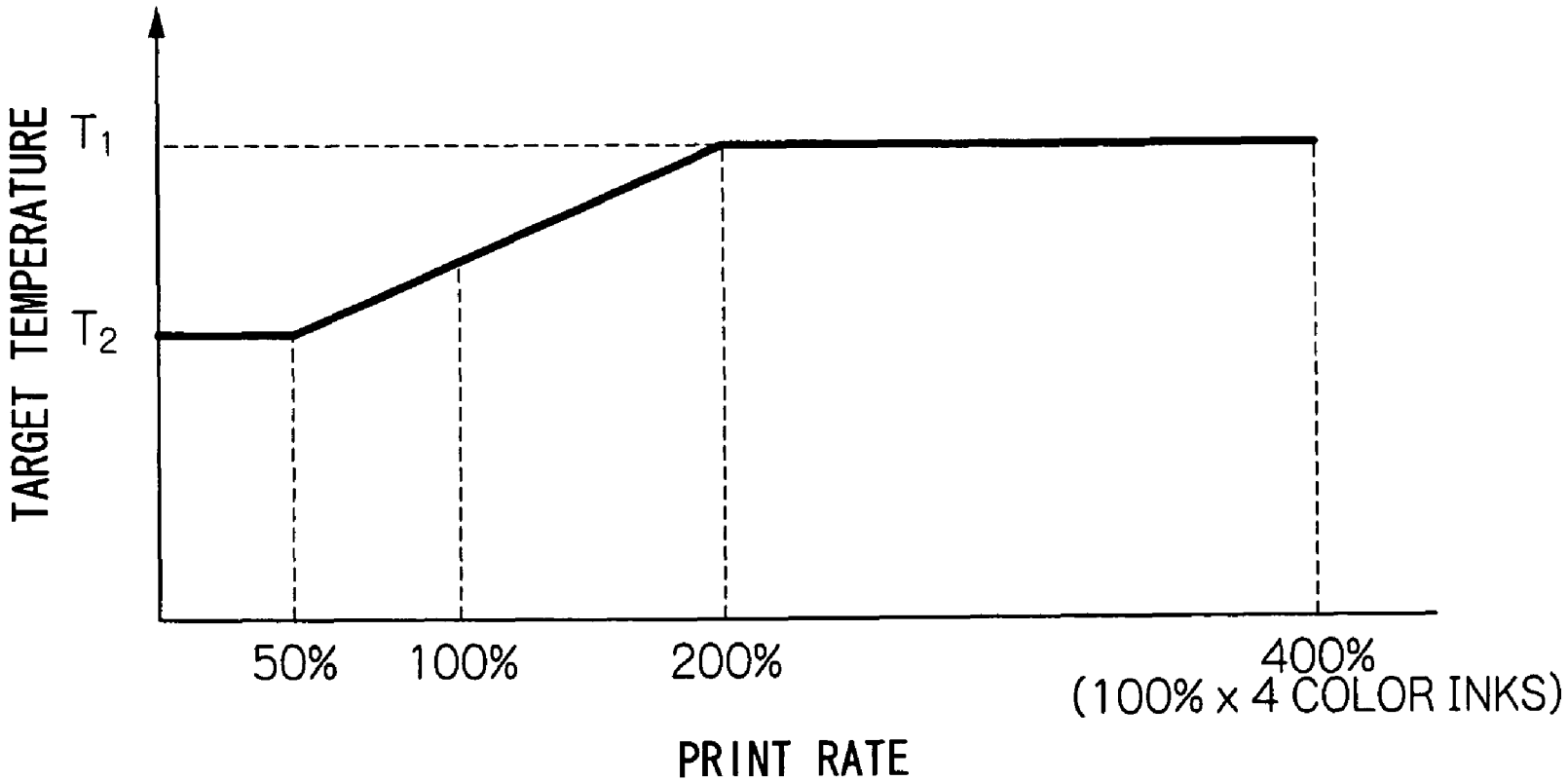
FIG. 9 is a diagram showing a relationship between the ejection rate and the set temperature of the heater.

FIG. 9 is a diagram showing the relationship between the ejection rate (print rate) and the set temperature of the ceramic heaters 34.

In FIG. 9, the horizontal axis means the ejection rate (print rate), and the vertical axis means the set temperature. In calculating this ejection rate (print rate), it is supposed that an inkjet recording apparatus carries out printing using the inks of four colors, and the ejection rate will have a value of 400% at maximum as follows: 100%×4=400%. Moreover, the set temperatures on the vertical axis have the following meanings: $T_1$ is the allowable temperature of the recording medium 16, which is the set temperature for heating the high print density region of the recording medium 16; $T_2$ is the set temperature for heating the low print density region of the recording medium 16; and $T_R$ is the room temperature. For example, in the case where the recording medium 16 is a PVC sheet, then $T_1$ is set to 70° C. and $T_2$ is set to 65° C.

As shown in FIG. 9, in the high print density region in which the total of the ejection rates (print rates) of the inks of the four colors is equal to or greater than 200%, the target temperature is set to $T_1$, while in the low print density region in which the total of the ejection rates (print rates) of the inks of the four colors is equal to or lower than 50%, the target temperature is set to $T_2$. Moreover, the target temperatures corresponding to areas where the total of the ejection rates (print rates) of the inks of four colors is between 50% and 200% are found by linear interpolation.

The temperature control procedure is described more specifically below.

The recording medium 16 is a flexible sheet that is made of polyvinyl chloride, has a thickness of 0.5 mm, a specific heat of 0.4 cal/° C.·g, and a specific gravity of 1.25 g/cm$^3$. The maximum allowable temperature of the recording medium (PVC sheet) is 70° C. The thickness of a PVC sheet used for an actual signboard is approximately 0.3 mm to 1.0 mm.

The ink is an ink containing a pigment of 5% and a cyclohexanone solvent of 90%. This ink has a specific heat of 0.45 cal/° C.·g, a latent heat of vaporization of 100 cal/g, and a specific weight of 1.0 g/cm$^3$.

It is supposed that the ink ejection volume for the print is 12 g/m$^2$ when the total ejection rate is 200%. This is based on an actual value measured from a solid gray image when the each ejection rate of C, M, Y, and K is 50%.

Figure 10:
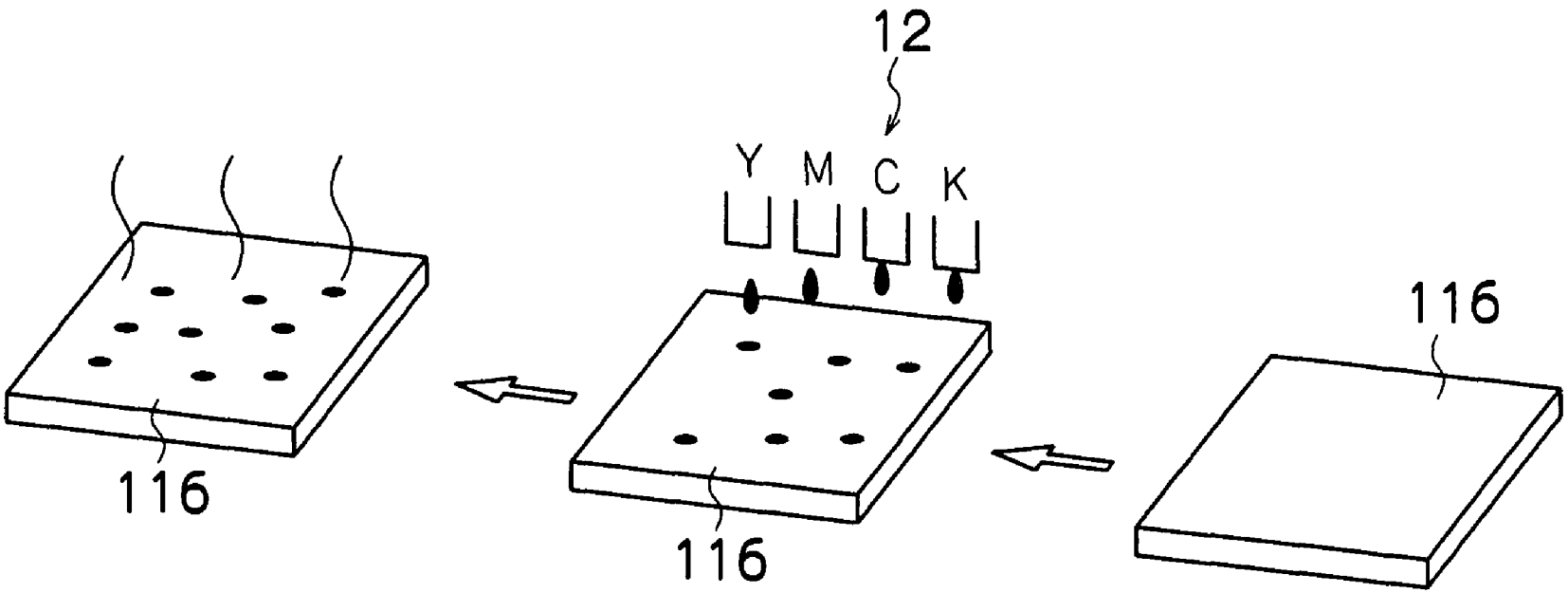
FIG. 10 is an illustrative diagram showing an aspect of printing onto a recording medium and heating control.

As shown in FIG. 10, the PVC sheet 116 having a thickness of 0.5 mm is heated to 70° C., and then after inks of the four colors are ejected by the print unit 12, the ink solvent is dried. In the following, the calculation is carried out for finding the heat (referred to as, hereinafter, "specific heat per square meter") required to increase the temperature of the PVC sheet 116 by 1° C., the heat absorbed by the deposited ink droplets, and the heat required for evaporation of the ink when the ink solvent is dried, per square meter of the PVC sheet 116, under the condition of the initial temperature of 70° C.

Firstly, the specific heat per square meter of the PVC sheet 116 (when heated to 70° C.) is obtained from the product of the specific heat, the volume(=area×thickness) per square meter and the specific weight as follows: 0.4 cal/° C.·g×500 $cm^3/m^2$ (=1 $m^2$×0.5 mm)×1.25 $g/cm^3$=250 cal/° C. $m^2$.

Thereupon, the amount of heat absorbed by the deposited ink droplets is calculated. The temperature of the PVC sheet 116 is initially 70° C., and ink having a temperature of 30° C. is deposited thereon. The amount of heat lost as a result of this heat adsorption is obtained from the product of the temperature difference between the PVC sheet and the ink, the specific heat of the ink, and the ink ejection volume per square meter: (70° C.−30° C.)×0.45 cal/° C.·g×12 $g/m^2$=216 $cal/m^2$.

Next, the heat required for evaporation of the ink is obtained from the product of the ink ejection volume per square meter, the content ratio of ink solvent and the latent heat of vaporization: 12 $g/m^2$×90%×100 cal/g=1080 $cal/m^2$.

By this means, the temperature drop caused by the deposition of ink droplets and the drying of the ink (evaporation) on the PVC sheet 116 that has been heated to 70° C. can be calculated as follows: (216 $cal/m^2$+1080 $cal/m^2$)/250 cal/° C. $m^2$=5.18° C.

Next, the actual temperature control for the high print density region and the low print density region is described below.

As described above, the high print density region is a region where ink is ejected at an ejection rate not less than a prescribed value, and more specifically, it is a region where the total of the ejection rates of the inks of four colors is 200% or above (in other words, where the average ejection rate for each color ink is 50% or above). On the other hand, the low print density region is a region where ink is ejected at an ejection rate not greater than a prescribed value, and more specifically, it is a region where the total of the ejection rates of the inks of four colors is 50% or less.

Figure 11:
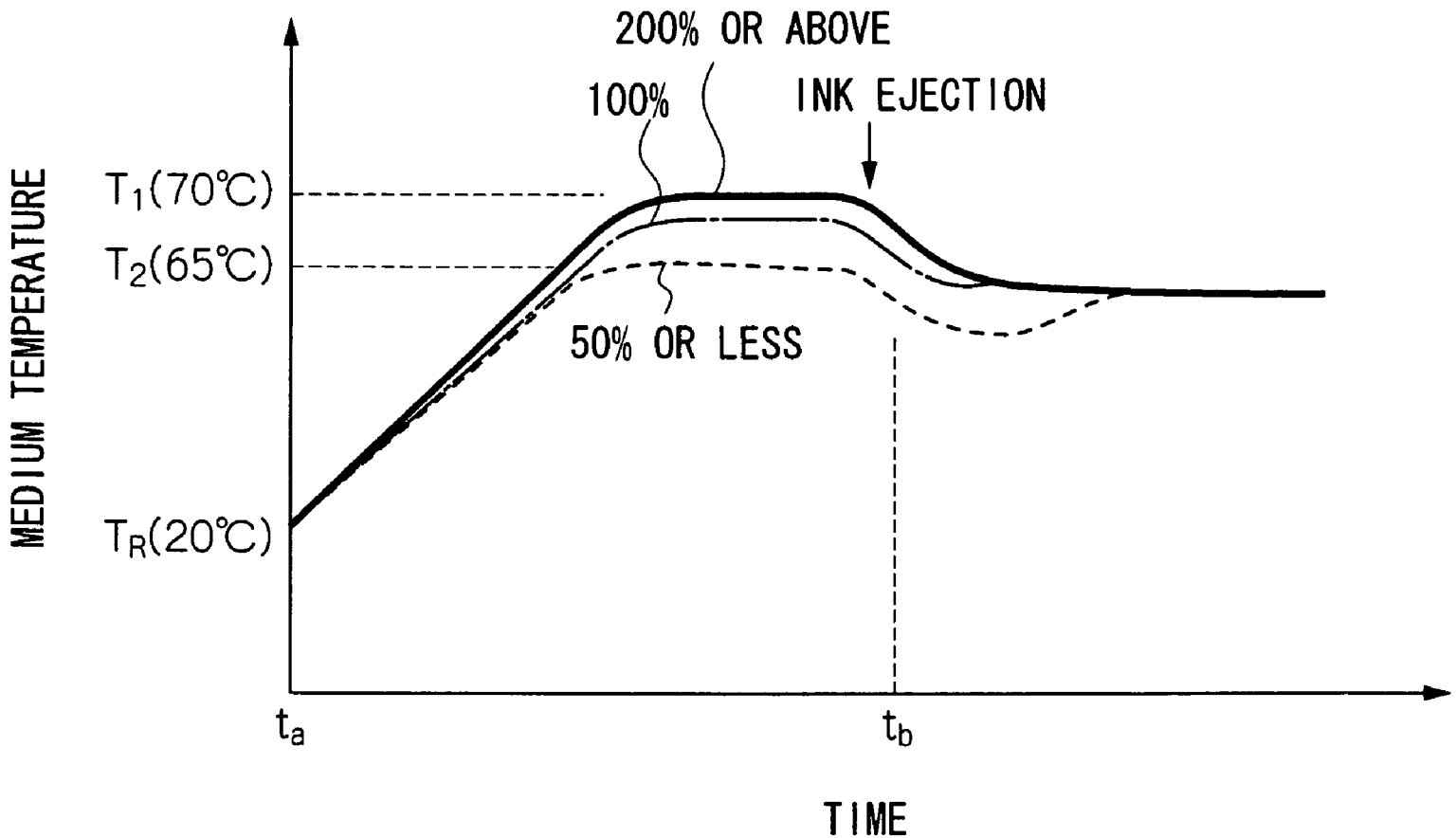
FIG. 11 is a diagram showing an aspect of temperature control for suppressing temperature differential between the high print density region and the low print density region.

FIG. 11 is a diagram showing a specific temperature control method for the high print density region and the low print density region.

In FIG. 11, the lateral axis indicates time and the vertical axis indicates the heater temperature. Three cases of different ejection rates are shown in FIG. 1: the solid line represents the temperature control for an area having an ejection rate of 200% or above; the dashed-dotted graph represents the temperature control for an area having an ejection rate of 100%; and the broken line represents the temperature control for an area having an ejection rate of 50% or less.

If, in order to achieve the maximum possible effect in drying the ink solvent, the recording medium is heated to a temperature close to the allowable temperature in the high print density region where the ejection rate is 200% or above, then the recording medium is liable to distort due to local thermal deformations as a result of the difference in the amount of thermal expansion between the high print density region and the low print density region where the ejection rate is 50% or less. In order to prevent this distortion, the temperature is controlled in such a manner that, as far as possible, a temperature differential does not arise between the high print density region and the low print density region.

Therefore, the target temperature of the low print density region is set to the same temperature as the temperature of the high print density region that has been subjected to the temperature drop due to the ink deposition from the maximum allowable temperature of the recording medium. In other words, the target temperatures are set in such a manner that the difference in the target temperature between the high print density region and the low print density region corresponds to an amount of heat required for the temperature rise and the vaporization (corresponding to evaporative latent heat of the ink) of the deposited ink droplets.

FIG. 11 shows the temperature of the recording medium during implementing the heater control described above with reference to FIGS. 7 and 8. As shown in FIG. 11, the set temperature (target temperature) $T_1$ for the high print density region is 70° C., and the set temperature (target temperature) $T_2$ for the low print density region is 65° C.

In both the high print density region and the low print density region, the heaters are switched on and heating of the recording medium is started, at the time point of $t_a$. The heaters for the high print density region are controlled so as to heat the areas of the recording medium to $T_1$. At the time point indicated by the arrow in FIG. 11, the ink droplets are ejected, and the temperature starts to fall to 65° C. because of the evaporation of the deposited ink droplets.

Similarly, in the low print density region, the temperature of the low print density region decreases due to the evaporation of the deposited ink droplets, after the ink droplets are ejected. However, the heaters for the low print density region are still controlled to keep the temperature of the recording medium at $T_2$ even after the time point of $t_b$ after the ink ejection, and the temperature of the low density region rises to reach 65° C.

It is supposed that the temperature of the high print density region falls by approximately 5° C. due to the evaporation of the ink. Therefore, the temperature of the high print density region falls from 70° C. to 65° C. In the areas of an ejection rate greater than 50% including the high print density region (the areas having an ejection rate of 200% or above), the temperature control is switched off at the time point of $t_b$ after the ink ejection, and at the same time, temperature control at $T_2$ (temperature control for keeping the recording medium at the temperature of $T_2$) is started. On the other hand, in the areas (the low print density region) where the ejection rate is 50% or lower, the temperature control at $T_2$ is maintained continuously.

In this way, since all the heaters implement the temperature control at $T_2$ in all the regions from the time point of $t_b$, then the subsequent temperature change is the same in all the regions.

Since the occurrence of excessive temperature variations in the recording medium is avoided by controlling the temperature in this way, then it is possible to prevent the deformation of the recording medium and to thereby improve the image quality.

The temperature control described above is explained below again with reference to the flowchart in FIG. 12.

Figure 12:
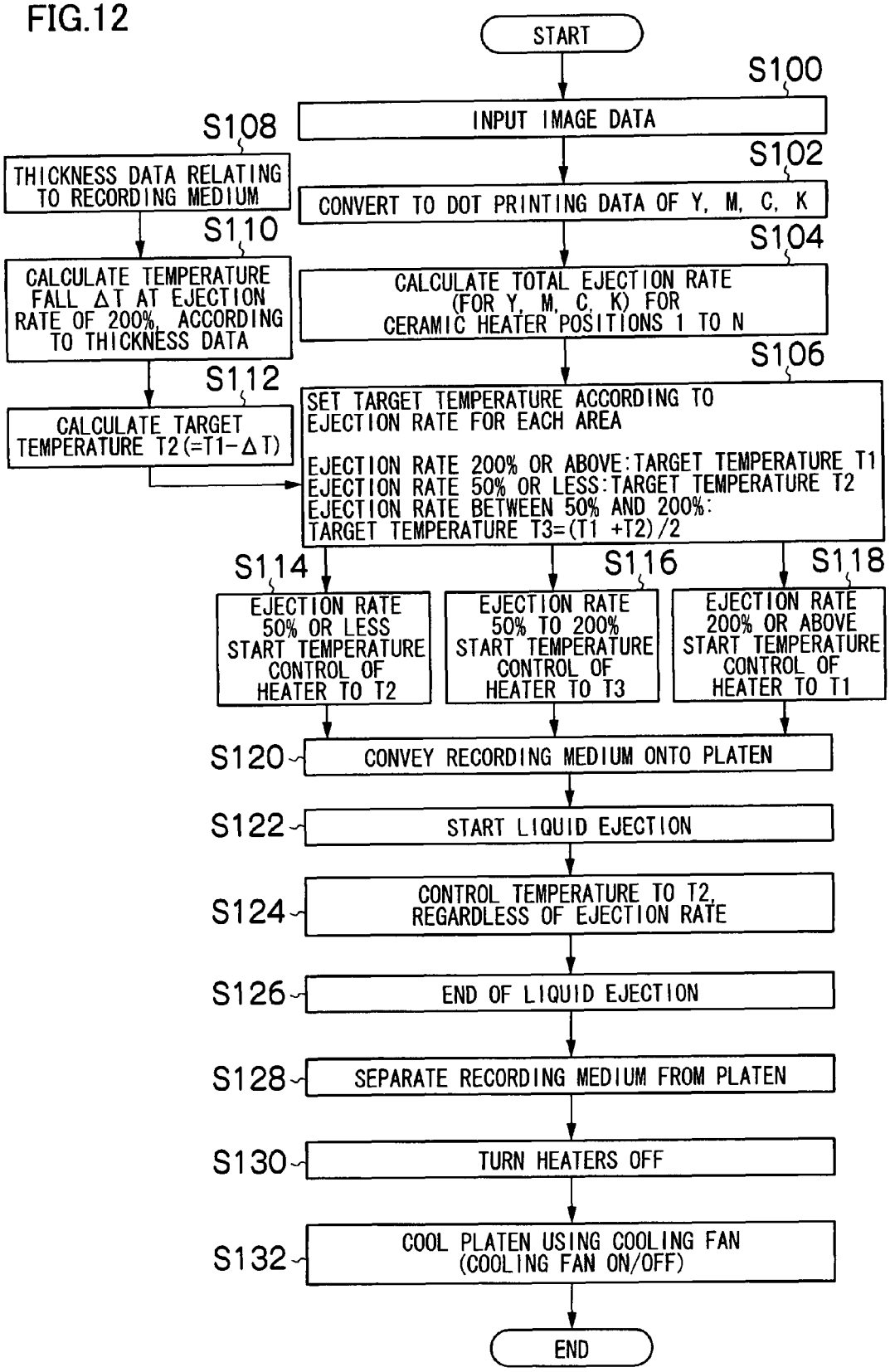
FIG. 12 is a flowchart showing heating control according to an embodiment of the present invention.

Firstly, image data is input at step S100 in FIG. 12, and the input image data is then converted into dot print data for the inks of the colors of Y, M, C, and K at step S102. The total ejection rate (for Y, M, C and K) is then calculated for an area of the recording medium corresponding to one ceramic heater, and this calculation is repeatedly carried out for all areas (corresponding to heater positions 1 to N, respectively) at step S104. In this case, each area has a size of 100.312 mm×100.312 mm since each area includes one heater of 100 mm×100 mm and intervals of 0.156 mm on either side. In the present embodiment, the number N of the ceramic heaters is 16×30, namely, N=480.

Thereupon, for each area, the target temperature is set on the basis of the ejection rate at that area, at step S106. Here, in an area where the ejection rate is 200% or above, $T_1$ may be set as the target temperature, in an area where the ejection rate is 50% or lower, $T_2$ may be set as the target temperature, and in an area where the ejection rate is 50% to 200%, $T_3=(T_1+T_2)/2$ may be set as the target temperature.

At step S108, thickness data of the recording medium is input by the operator, and at step S110, the temperature drop $\Delta T$ at an ejection rate of 200% is calculated on the basis of this thickness data. Here, the ink properties (the solvent volume, the specific heat, the latent heat of vaporization, and the specific gravity) are already known. Similarly, the characteristics of the recording medium, such as the specific heat, the specific gravity, the allowable temperature $T_1$, and the like, are already known. Moreover, at step S112, the set temperature $T_2$ is calculated on the basis of the equation $T_2=T_1-\Delta T$. At step S106, the target temperatures are calculated using these values. It is also possible to store values of $T_2$ according to the thickness of the recording medium in a memory in the form of a table.

Next, at step S114, temperature control which sets the heaters to the temperature $T_2$ is started for the areas where the ejection rate is 50% or lower. Similarly, at step S116, temperature control which sets the heaters to the temperature $T_3$ is started for the areas where the ejection rate is 50% to 200%. Moreover, at step S118, temperature control which sets the heaters to the temperature $T_1$ is started for the areas where the ejection rate is 200% or above.

Thereupon, at step S120, the recording medium 16 is conveyed and placed on the platen 32, and at the next step S122, liquid ejection toward the recording medium 16 is started.

After the ejection of liquid, the temperature is controlled to $T_2$ at step S124, regardless of the ejection rate. In this case, the target temperatures for all areas are successively changed to $T_2$ in the order of liquid ejection. In other words, when the liquid is ejected and deposited on a specified area of the recording medium, then the target temperature for that area is changed to $T_2$, and the temperature of that area is controlled and adjusted to $T_2$. The liquid ejection is completed at step S126, and the recording medium 16 is conveyed and separated from the platen 32 at step S128. At step S130, the heaters are successively switched off in the order of the separation from the recording medium 16. At step 132, the platen 32 is cooled by the cooling fan 38.

As described above, according to the present embodiment, by promoting the removal of ink solvent in areas (high print density region) where a large amount of ink is ejected, as well as eliminating the temperature difference between those areas (high print density region) and areas (low print density region) where little ink (or no ink) is ejected, a temperature distribution of the recording medium can achieve as uniform as possible. In this way, it is possible to prevent deformation of the recording medium and to improve the image quality.

An image forming apparatus and an image forming method according to the present invention are described in detail above, but the present invention is not limited to these embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

an ejection head which ejects droplets of liquid toward a recording medium in accordance with image data;

a hold device which holds the recording medium;

a conveyance device which conveys the recording medium relatively to the ejection head while the recording medium is held by the hold device;

a heating device which is provided with the hold device and is capable of heating a part of the recording medium selectively; and a control device which controls the heating device in accordance with the image data so that, before the droplets of the liquid are ejected by the ejection head, the recording medium is heated by the heating device in accordance with a heating pattern in which a first temperature not greater than an allowable temperature of the recording medium is set for a first region of the recording medium where a liquid ejection rate is not less than a first threshold value while a second temperature less than the first temperature is set for a second region of the recording medium where the liquid ejection rate is not greater than a second threshold value not greater than the first threshold value, wherein:

the ejection head is an ink ejection head which ejects inks of four colors; and the recording medium is heated by the heating device before ink ejection until after the ink ejection in accordance with the heating pattern in which the first temperature is set for the first region of the recording medium where a sum of ejection rates for the inks of the four colors is not less than 200% and the second temperature less than the first temperature is set for the second region of the recording medium where the sum of the ejection rates for the inks of the four colors is not greater than 50%.

2. The image forming apparatus as defined in claim 1, further comprising a cooling device which cools the heating device so as to clear the heating pattern for the previous recording medium, after image formation on the previous recording medium held by the hold device is completed and before a new recording medium is held by the hold device.

3. The image forming apparatus as defined in claim 1, wherein:

the conveyance device is a belt conveyor;

the hold device is a flat-shaped platen which is provided on the belt conveyor and holds an end portion of the recording medium; and the heating device includes a plurality of flat and square ceramic heaters which are arranged on the flat-shaped platen in a matrix configuration at a prescribed interval apart.

4. The image forming apparatus as defined in claim 1, wherein:

each of the inks contains a pigment as a coloring material and cyclohexanone as a solvent; and the recording medium is a flexible sheet made of polyvinyl chloride.

5. An image forming method of forming an image by ejecting droplets of liquid toward a recording medium in accordance with image data, the method comprising the steps of:

calculating a liquid ejection rate at which the droplets of the liquid are ejected toward the recording medium, in accordance with the image data;

carrying out a first temperature control so that a first temperature not greater than an allowable temperature of the recording medium is set for a first region of the recording medium where the liquid ejection rate is not less than a first threshold value while a second temperature less than the first temperature is set for a second region of the recording medium where the liquid ejection rate is not greater than a second threshold value not greater than the first threshold value, before the droplets of the liquid are ejected toward the recording medium; and carrying out a second temperature control so that temperature of the recording medium is adjusted to the second temperature regardless of the liquid ejection rate, after the droplets of the liquid are ejected toward the recording medium, wherein:

the liquid includes inks of four colors; and the recording medium is heated before ink ejection until after the ink ejection in accordance with a heating pattern in which the first temperature is set for the first region of the recording medium where a sum of ejection rates for the inks of the four colors is not less than 200% and the second temperature less than the first temperature is set for the second region of the recording medium where the sum of the ejection rates for the inks of the four colors is not greater than 50%.

6. A liquid droplet ejection apparatus, comprising:

an ejection head which ejects droplets of liquid toward a recording medium in accordance with liquid ejection data;

a hold device which holds the recording medium;

a conveyance device which conveys the recording medium relatively to the ejection head while the recording medium is held by the hold device;

a heating device which is provided with the hold device and selectively heats a part of the recording medium;

a control device which controls the heating device in accordance with the liquid ejection data so that, before the droplets of the liquid are ejected by the ejection head, the recording medium is heated by the heating device in accordance with a heating pattern in which a first temperature not greater than an allowable temperature of the recording medium is set for a first region of the recording medium where a liquid ejection rate is not less than a first threshold value while a second temperature less than the first temperature is set for a second region of the recording medium where the liquid ejection rate is not greater than a second threshold value not greater than the first threshold value, wherein:

the ejection head is an ink ejection head which ejects inks of four colors; and the recording medium is heated by the heating device before ink ejection until after the ink ejection in accordance with the heating pattern in which the first temperature is set for the first region of the recording medium where a sum of ejection rates for the inks of the four colors is not less than 200% and the second temperature less than the first temperature is set for the second region of the recording medium where the sum of the ejection rates for the inks of the four colors is not greater than 50%.

7. A liquid droplet ejection method of ejecting droplets of liquid toward a recording medium in accordance with liquid ejection data, the method comprising the steps of:

calculating a liquid ejection rate at which the droplets of the liquid are ejected toward the recording medium, in accordance with the liquid ejection data;

carrying out a first temperature control so that a first temperature not greater than an allowable temperature of the recording medium is set for a first region of the recording medium where the liquid ejection rate is not less than a first threshold value while a second temperature less than the first temperature is set for a second region of the recording medium where the liquid ejection rate is not greater than a second threshold value, before the droplets of the liquid are ejected toward the recording medium; and carrying out a second temperature control so that temperature of the recording medium is adjusted to the second temperature regardless of the liquid ejection rate, after the droplets of the liquid are ejected toward the recording medium, wherein:

the liquid includes inks of four colors; and the recording medium is heated before ink ejection until after the ink ejection in accordance with a heating pattern in which the first temperature is set for the first region of the recording medium where a sum of ejection rates for the inks of the four colors is not less than 200% and the second temperature less than the first temperature is set for the second region of the recording medium where the sum of the ejection rates for the inks of the four colors is not greater than 50%.

* * * * *